United States Patent [19]

Michalak

[11] 4,310,046

[45] Jan. 12, 1982

[54] REGENERATIVE HEAT EXCHANGER

[75] Inventor: Stanislaw Michalak, Reichshof, Fed. Rep. of Germany

[73] Assignee: L. & C. Steinmüller GmbH, Gummersbach, Fed. Rep. of Germany

[21] Appl. No.: 197,797

[22] Filed: Oct. 17, 1980

[30] Foreign Application Priority Data

Dec. 20, 1979 [DE] Fed. Rep. of Germany ..... 2951279

[51] Int. Cl.[3] ..... F28D 13/00; F28D 19/00

[52] U.S. Cl. ..... 165/5; 165/10; 165/8; 165/104.16

[58] Field of Search ..... 165/5, 8, 10, 104 F

[56] References Cited

U.S. PATENT DOCUMENTS

| | | | |
|---|---|---|---|
| 1,762,320 | 6/1930 | Wood | 165/8 X |
| 2,680,008 | 6/1954 | Karlsson | 165/8 |
| 2,858,110 | 10/1958 | Blasbowski | 165/10 X |
| 3,872,918 | 3/1975 | Stalber | 165/10 X |

*Primary Examiner*—Albert W. Davis

*Attorney, Agent, or Firm*—Becker & Becker, Inc.

[57] ABSTRACT

A regenerative heat exchanger. The rotor is an annular body and includes several rotationally symmetrical chambers which are separated from one another by walls, with the axially parallel dividing walls being permeable for the gaseous heat-dissipating or heat-receiving medium, and the radial dividing walls being permeable for the gaseous medium; heat-transferring elements for the regenerative heat exchange are arranged in the chambers accompanied by formation of a whirl layer during operation. The chambers have radial flow therethrough.

2 Claims, 1 Drawing Figure

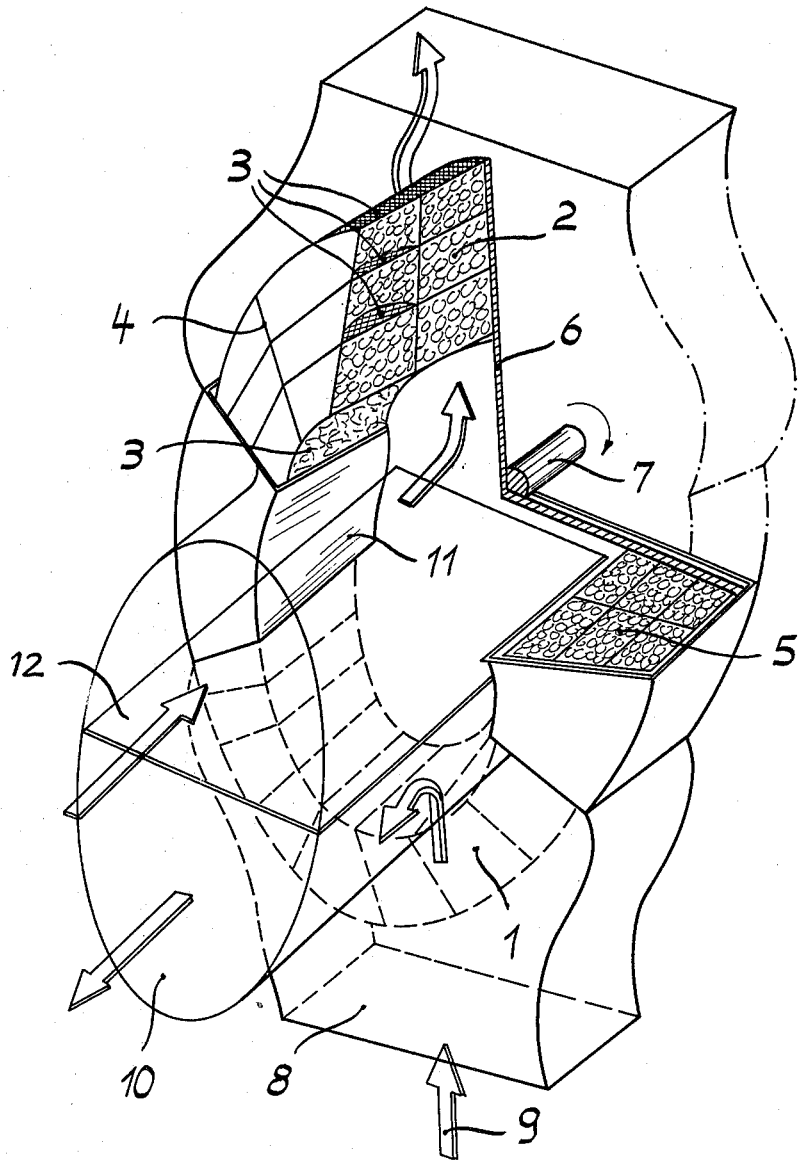
3
2
4
6
3
7
11
12
5
1
10
8
9

REGENERATIVE HEAT EXCHANGER

The present invention relates to a regenerative heat exchanger.

The known regenerative heat exchangers, for instance using the Ljungstrom principle, are equipped with huge heat storage masses in the form of plates, ceramic plates, and other elements which comprise different materials.

The heat storage of the mass of the rotor occurs in a hot-gas flow (secondary air). The heat transfer in the cold-gas flow (primary air) occurs by means of the rotation of the rotor, and the incident or oncoming gas flow parallel to the axis of the rotor.

In many cases, especially with heat exchange between gases with high dust or powder content and gases with temperatures below the dew point, it is noted that crusts and deposits form in the storage mass of the known heat exchangers; these crusts or deposits are difficult to remove again. These deposits cause problems with the heat exchange, as well as causing an increase of the pressure loss of the gas through-flow through the storage mass.

For this reason, the regenerative heat exchangers are equipped with cleaning devices which blow off the deposits or crusts with steam, vapor, or with air.

It is an object of the present invention to provide a regenerative heat exchanger which makes possible an intensive heat exchange between secondary and primary gas flows, and assures a problemless self-cleaning of the storage mass without additional cleaning equipment or devices.

This object, and other objects and advantages of the present invention, will appear more clearly from the following specification in connection with the accompanying drawing, which schematically illustrates a regenerative heat exchanger having features in accordance with the teaching of the present invention.

The heat exchanger of the present invention is characterized primarily in that the rotor is an annular body comprising several rotationally symmetrical chambers which are separated from one another by walls, with the axially parallel dividing walls being permeable for the gaseous heat-dissipating or heat-receiving medium, and the radial dividing walls being impermeable for the gaseous medium; heat-transferring elements for the regenerative heat exchange are arranged in the chambers accompanied by formation of a whirl or fluidized layer during operation.

Inventively, the chambers have radial flow therethrough.

Referring now to the drawing in detail, the inventive heat exchanger comprises a ring or annular body 1 which is embodied as a rotor and includes chambers 2 formed by partitions or dividing walls 3 and 4 and filled with the heat-transferring elements 5. The rotor is fastened or secured on a rotatable flat plate 6 having a shaft 7.

In the lower part of the heat exchanger, there is located an inlet channel 8 through which the gas 9 (for instance secondary gas) is supplied radially to the rotor. After the heat is given off to the elements 5 embodied as a storage mass, the gas 9 leaves the heat exchanger through the discharge or outlet channel 10. The upper part of the heat exchanger is symmetrical to the lower part of the heat exchanger, except that the channels have opposite functions, i.e. the inlet channel for the secondary gas is identical with the outlet channel for the primary gas.

The hot gas side and the cold gas side of the regenerative heat exchanger are separated from each other by the sealing elements 11 and the guide plate 12. The elements 5 of the whirl or fluidized-layer mass can for example, be rigid hollow spheres or hollow polyhedrons, with the free inner spaces or chambers thereof being partially filled with a heat-conducting liquid as well as vapor from this liquid.

In the known regenerative heat exchangers with vertical shafts and with counter flow of the gases, it is not possible to attain a or fluidized layer on both sides in the storage mass.

For this reason, the heat exchanger was advantageously created with a horizontally located rotor shaft and with radial primary- and secondary-air flow thereto. The rotor 1 in this connection has the form of a ring and is subdivided into radial sectors or segments and concentric zones, which form the chambers 2 for the storage mass 5. The axially parallel dividing walls 3 for the gaseous heat-dissipating or heat-receiving medium are permeable, and the radial dividing walls 4 for the gaseous medium are impermeable. The primary and secondary gases flow through the annular rotor 1 in a counter flow principle, i.e. one flow from the inside to the outside, and the secondary flow from the outside to the inner chamber or space of the rotor.

The decisive advantage of the present invention consists in that the inventive heat exchanger with the whirl or fluidized-layer storage mass is insensitive to contaminations or impurities of the gases.

As a result of the very good heat conducting capability of the elements in the individual chambers, high heat transfer factors result. In addition, due to the low weight of the elements, the rotor can be operated or driven at a speed which is higher than the conventional or previously known heat exchangers.

The present invention is, of course, in no way restricted to the specific disclosure of the specification and drawing, but also encompasses any modifications within the scope of the appended claims.

What I claim is:

1. A regenerative heat exchanger, including a rotor which is in the form of an annular body and comprises a plurality of rotationally symmetrical chambers which are separated from one another, the formation and separation of said chambers being effected by axially parallel dividing walls and radially extending dividing walls, said axially parallel dividing walls being permeable for gaseous heat-dissipating and heat-receiving medium, and said radial dividing walls being impermeable for said gaseous medium; heat-transferring elements for the regenerative heat exchange being arranged in said chambers, said heat-transferring elements being accompanied by the formation of a whirl or fluidized layer during operation of said rotor.

2. A heat exchanger according to claim 1, in which said chambers are adapted to receive flow radially therethrough.

* * * * *